US009409692B2

(12) United States Patent
Babey et al.

(10) Patent No.: US 9,409,692 B2
(45) Date of Patent: Aug. 9, 2016

(54) FLEXIBLE SHIPMENT PACKAGING

(75) Inventors: Matthias Babey, Potsdam (DE); Gerhard Graumüller, Gera (DE); Matthias Jungbluth, Berlin (DE); Reinhard Krannig, Bürgel (DE); Carsten Köppen, Berlin (DE); Volker Tränkle, Stuttgart (DE); Gunther Wendt, Berlin (DE); Rolf Wilkenhöner, Kleinmachnow (DE)

(73) Assignee: SIEMENS AKTIENGESELLSCHAFT, München (DE)

( * ) Notice: Subject to any disclaimer, the term of this patent is extended or adjusted under 35 U.S.C. 154(b) by 893 days.

(21) Appl. No.: 13/512,991

(22) PCT Filed: Dec. 3, 2009

(86) PCT No.: PCT/EP2009/066343

§ 371 (c)(1),
(2), (4) Date: Aug. 6, 2012

(87) PCT Pub. No.: WO2011/066859

PCT Pub. Date: Jun. 9, 2011

(65) Prior Publication Data

US 2013/0134069 A1 May 30, 2013

(51) Int. Cl.
*B65D 85/62* (2006.01)
*B65D 81/02* (2006.01)
(Continued)

(52) U.S. Cl.
CPC ..... *B65D 81/022* (2013.01); *B65D 19/04* (2013.01); *B65D 25/04* (2013.01); *B65D 25/108* (2013.01); *B65D 81/113* (2013.01); *B65D 85/68* (2013.01); *B65D 2519/00034* (2013.01); *B65D 2519/00069* (2013.01); *B65D 2519/0086* (2013.01); *B65D 2519/00174* (2013.01); *B65D 2519/00208* (2013.01); *B65D 2519/00268* (2013.01); *B65D 2519/00288* (2013.01); *B65D 2519/00318* (2013.01); *B65D 2519/00333* (2013.01);
(Continued)

(58) Field of Classification Search
CPC .... B65D 19/04; B65D 81/022; B65D 25/108; B65D 25/04; B65D 85/68; B65D 81/113
USPC ..... 206/443, 499, 503, 509, 523, 585, 587, 206/591, 592, 593; 220/212, 253, 528, 529, 220/553; 229/120.02, 120.06; 410/34, 44, 410/45
See application file for complete search history.

(56) References Cited

U.S. PATENT DOCUMENTS 1,305,908 A * 6/1919 Lanier ..... 206/499
3,306,439 A * 2/1967 Storey ..... 206/499
(Continued)

FOREIGN PATENT DOCUMENTS

EP 0197244 A2 10/1986
EP 0486489 B1 11/1994
(Continued)

*Primary Examiner* — Luan K Bui

(57) ABSTRACT

A shipment packaging for elongate components is provided. Turbine blades must be sent from remote locations of the world to another location. During shipment, the coating of the turbine blades must be protected. The turbine blades are fixed at both ends by means of shipment packaging so that the turbine blades are protected.

8 Claims, 7 Drawing Sheets

(51) Int. Cl.

| | |
|---|---|
| ***B65D 19/04*** | (2006.01) |
| ***B65D 25/04*** | (2006.01) |
| ***B65D 25/10*** | (2006.01) |
| ***B65D 81/113*** | (2006.01) |
| ***B65D 85/68*** | (2006.01) |

(52) U.S. Cl.

CPC ..... *B65D2519/00497* (2013.01); *B65D 2519/00711* (2013.01); *B65D 2585/6875* (2013.01)

(56) References Cited

U.S. PATENT DOCUMENTS

| | | | | | |
|---|---|---|---|---|---|
| 3,343,671 | A | * | 9/1967 | Weinstein | 206/499 |
| 4,640,418 | A | * | 2/1987 | Lowry | 206/499 |
| 4,826,012 | A | * | 5/1989 | Kosanovich | 206/499 |
| 5,154,885 | A | | 10/1992 | Czech et al. | |
| 5,271,499 | A | * | 12/1993 | Van Horssen | 206/523 |
| 5,401,307 | A | | 3/1995 | Czech et al. | |
| 5,628,403 | A | | 5/1997 | Ordonez | |
| 5,992,634 | A | | 11/1999 | Woodring | |
| 5,993,980 | A | | 11/1999 | Schmitz et al. | |
| 6,007,779 | A | * | 12/1999 | Lemieux et al. | 206/499 |
| 6,024,792 | A | | 2/2000 | Kurz et al. | |
| 6,227,370 | B1 | * | 5/2001 | Earnshaw et al. | 206/509 |
| 6,231,692 | B1 | | 5/2001 | Vogt et al. | |
| 6,610,419 | B1 | | 8/2003 | Stamm | |
| 6,612,454 | B1 | * | 9/2003 | Lin | 220/528 |
| 7,005,015 | B2 | | 2/2006 | Bürgel et al. | |
| 7,258,235 | B2 | | 8/2007 | Liu | |
| 7,644,858 | B2 | * | 1/2010 | Glaser et al. | 229/120.06 |
| 2004/0011439 | A1 | | 1/2004 | Corrigan et al. | |
| 2007/0251858 | A1 | * | 11/2007 | Martinez | 206/499 |
| 2009/0101538 | A1 | * | 4/2009 | Chen et al. | 206/585 |

FOREIGN PATENT DOCUMENTS

| | | | |
|---|---|---|---|
| EP | 0412397 | B1 | 3/1998 |
| EP | 0892090 | A1 | 1/1999 |
| EP | 0786017 | B1 | 3/1999 |
| EP | 1306454 | A1 | 5/2003 |
| EP | 1319729 | A1 | 6/2003 |
| EP | 1204776 | B1 | 6/2004 |
| EP | 1645525 | A1 | 4/2006 |
| EP | 1801024 | A2 | 6/2007 |
| EP | 1916197 | A1 | 4/2008 |
| JP | 2008174255 | A | 7/2008 |
| RU | 21274 | U1 | 1/2002 |
| WO | WO 9967435 | A1 | 12/1999 |
| WO | WO 0044949 | A1 | 8/2000 |

* cited by examiner

FLEXIBLE SHIPMENT PACKAGING

CROSS REFERENCE TO RELATED APPLICATIONS

This application is the US National Stage of International Application No. PCT/EP2009/066343, filed Dec. 3, 2009 and claims the benefit thereof. All of the applications are incorporated by reference herein in their entirety.

FIELD OF INVENTION

The invention relates to a shipment packaging for elongate components, in particular turbine blades or vanes.

BACKGROUND OF INVENTION

Elongate components such as turbine blades or vanes are sent incorporated together with the rotor of the turbine.

During retrofitting, turbine blades or vanes are refurbished and sent back again to technical installations throughout the world. These may also be new turbine blades or vanes which replace old ones, or refurbished turbine blades or vanes.

The turbine blades or vanes have protective layers which should not be damaged during transportation.

SUMMARY OF INVENTION

Therefore, it is an object of the invention to solve the aforementioned problem.

The object is achieved by a shipment packaging as claimed in the claims.

The advantage consists in the flexibility of the reception of various types of components.

The dependent claims list further advantageous measures which can be combined with one another, as desired, in order to obtain further advantages.

The shipment packaging as claimed in the claims can be improved in each case alone or in any desired combination by:

a shipment packaging,
wherein the turbine components (120, 130) are held,
in particular fixed,
standing in the plug-in divider (13', 13", 13'"),
a shipment packaging,
wherein the turbine components (120, 130) are held,
in particular fixed,
hanging in the plug-in divider (13', 13", 13'"),
a shipment packaging,
wherein the turbine components (120, 130) are held,
in particular fixed,
lying in the plug-in divider (13', 13", 13'"),
a shipment packaging,
wherein the plug-in divider (13', 13", 13'") comprises polypropylene trilaminate,
in particular consists thereof,
a shipment packaging,
wherein a plurality of inner packagings (10', 10", 10') are present in layers in the internal space (7) of the container (5),
a shipment packaging,
wherein two turbine components (120, 130),
in particular only two components (120, 130),
are arranged in a compartment (25', 25") of the plug-in divider (13', 13", 13'),
a shipment packaging,
wherein only one turbine component (120, 130) is arranged in a compartment (25', 25") of the plug-in divider (13, 28),
a shipment packaging, wherein the plug-in divider (13', 13", 13'") comprises a plurality of compartments (25', 25"), and
wherein a receptacle (19, 22, 22") for holding the turbine component (120, 130) is present in a compartment (25', 25") of the plug-in divider (13),
preferably at least one separate receptacle (19, 22, 22", 50),
which preferably consists of a foam,
very preferably of a PE foam,
a shipment packaging,
wherein the receptacle (19, 22', 22", 41, 44, 50) can receive only one turbine component (120, 130),
a shipment packaging,
wherein the receptacle (19, 22, 22", 41, 44, 50) can receive two turbine components (120, 130),
a shipment packaging,
wherein a receptacle (19, 22, 34, 41, 44, 50) can receive only identical turbine blades or vanes (120, 130),
a shipment packaging,
wherein various receptacles (19, 22, 34, 41, 44, 50) are present in the compartments (25', 25", . . . ) of a plug-in divider (13', 13", 13'),
a shipment packaging,
which comprises a contoured plate (37),
a shipment packaging,
which comprises a protective cover (18),
a shipment packaging,
which comprises a suspending contoured plate (31) in each layer,
a shipment packaging,
wherein there is no contoured plate in each layer,
a shipment packaging,
wherein a plug-in divider cover (16) is present in each layer,
a shipment packaging,
wherein the contoured plate (37) comprises at least one opening (38),
through which the turbine component (120, 130),
in particular a turbine rotor blade (120), is inserted and held,
a shipment packaging,
wherein the contoured plate (37) comprises an opening (38),
which encloses a platform of a guide vane (130) in order to fix it,
a shipment packaging,
which comprises a plug-in divider cover (16),
which comprises means (17) for fixing the turbine component (120, 130) in each compartment (25', 25"),
a shipment packaging,
wherein the fixing means (17) represent corrugated foams, which preferably have a groove-like form,
a shipment packaging,
which comprises an upper receptacle (53) and a lower receptacle (50),
preferably consisting of a foam, in a compartment (25', 25", . . . ),
a shipment packaging,
which comprises two lateral receptacles (41, 44) in a compartment (25', 25", . . . ) of the plug-in divider (13),
a shipment apparatus,
which, at the base of a plug-in divider (13', 13", . . . ), comprises a receptacle (22'"'") for the end of a turbine blade or vane (120, 130),
a shipment packaging,
wherein the receptacle (19) has a negative form of a region of the component (120, 130),
a shipment packaging, wherein at most two components (120, 130) are arranged in each compartment (25', 25"), a shipment packaging, which comprises an insert (49), which directly faces the outer cover, and comprises blocks (47', 47") for the transmission of force from the cover to the plug-in divider (13', 13", . . . ), a shipment apparatus, which additionally comprises a reinforcement (60) for the plug-in divider (13', 13", . . . ), a shipment packaging, wherein the plug-in divider cover (16) comprises a plurality of means (17) for fixing, which (17) are formed in a manner corresponding to the cross section of a compartment (25', 25", . . . ), in particular comprises such means (17) in each compartment (25', 25", . . . ), and/or by a shipment packaging, the parts of which that come into contact with the components (120, 130), such as the plug-in divider (13', 13", . . . ) and blade or vane receptacle (22, 22', 22", . . . ), are produced from a material which cannot damage the component (120, 130), in particular polypropylene trilaminate, PE foam.

Figure 1:
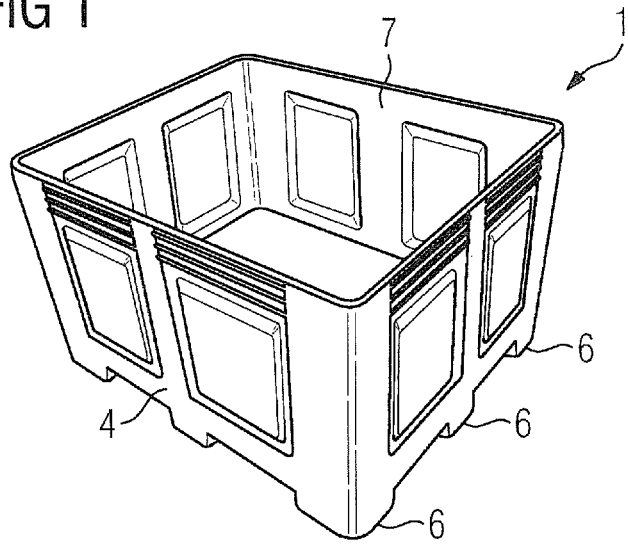
FIGS. 1-11 show elements of a shipment packaging.

The description and the drawing represent only exemplary embodiments of the invention.

DETAILED DESCRIPTION OF INVENTION

The elongate components can be ring segments or combustion chamber components of gas turbines or preferably turbine blades or vanes 120, 130, in respect of which the invention is only explained in more detail by way of example.

The blades or vanes 120, 130 which are packaged and sent can be blades or vanes of gas turbines, steam turbines or aircraft turbines.

Similarly, the shipment packaging 1 is suitable for transportation within a plant or between suppliers and the plant.

The blades or vanes 120, 130 can be guide vanes or rotor blades from the first, second, third or fourth row of turbines or from all rows of a turbine.

In this case, a distinction is made between rotor blades and guide vanes, with the guide vanes 130 generally comprising an upper and a lower platform. The rotor blades 120 often comprise only a lower platform 403, however.

FIG. 1 shows an outer packaging 4 of a shipment packaging 1.

The outer packaging 4 preferably consists of HDPE and preferably comprises runners 6, in particular three runners 6, on the outside on the base. Base means bottom.

For identifying the shipment unit, the outer packaging 4 preferably likewise comprises a self-adhesive document pocket on the outside.

For the shipment packaging, there is an outer cover (not shown), which suitably covers the outer packaging 4 at the top. Outer cover means top.

The shipment packaging 1 preferably has a flame-retardant design.

At least one inner packaging 10', 10", 10', . . . , which is shown in FIG. 2, 3, 4, 5, 6, 7, 8, 9, 10 or 11, reaches into the internal space 7 of the outer packaging 4.

It is preferable that the inner packaging 10', 10", 10', . . . can be inserted into the outer packaging 4 in a plurality of layers, as shown in FIGS. 2-11.

Figure 2:
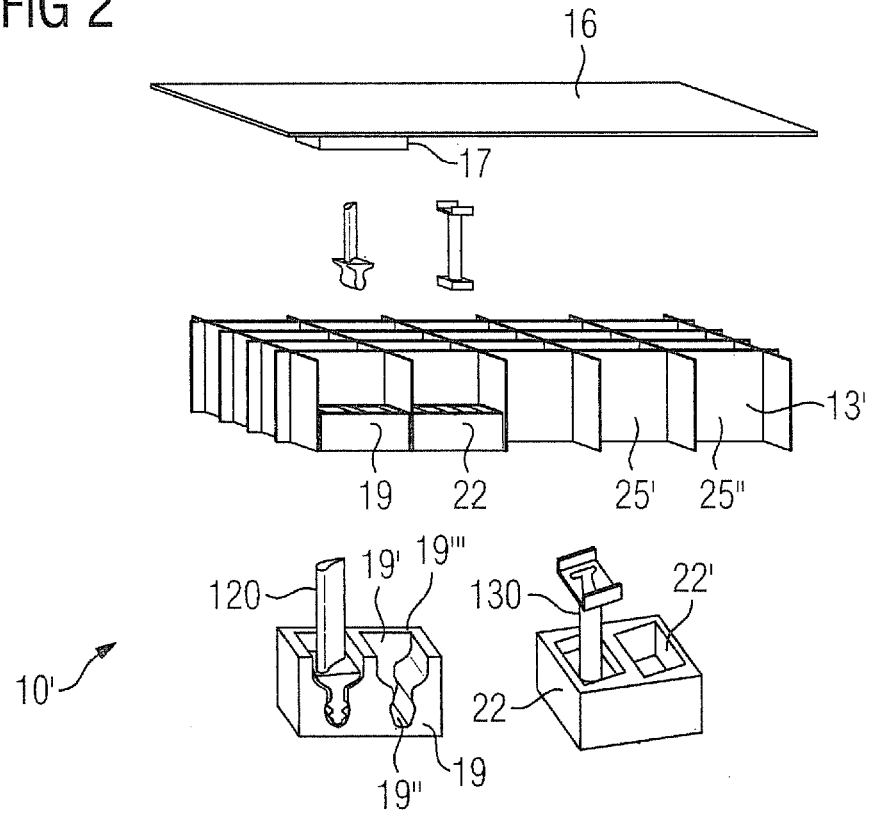

FIG. 2 shows a first exemplary embodiment of an inner packaging 10', preferably for relatively small (first/second row of the turbine) turbine blades or vanes 120, 130.

The turbine components 120, 130 are arranged individually or as a pair in a compartment 25', 25", . . . of a plug-in divider 13' (grid divider), but always in such a way that the components 120, 130 do not touch one another.

The plug-in dividers 13', 13", 13'" preferably consist of polypropylene trilaminate.

There are preferably no more than two components 120, 130 in each compartment 25', 25".

The blades or vanes 120, 130 are held, preferably fixed, standing in the compartment 25', 25" . . . .

At the base, the compartments 25', 25" preferably each comprise a receptacle 19, 22, into which the turbine component 120, 130 is introduced. The receptacle 19, 22 (FIGS. 2-11) preferably has the same cross section as the compartments 25', 25" in FIGS. 2-11.

The receptacles 19, 22 (FIGS. 4, 6, 8) are preferably separate modules of the inner packaging 10', 10", . . . .

In this example, the blades or vanes 120, 130 are fixed standing in a compartment 25', 25" by the receptacle 19, 22.

In each compartment 25', 25", there is preferably a receptacle 19 for turbine blades or vanes of the same type. However, various receptacles 19, 22 for various turbine blades or vanes 120, 130 may be present in a plug-in divider 13'.

Figure 6:
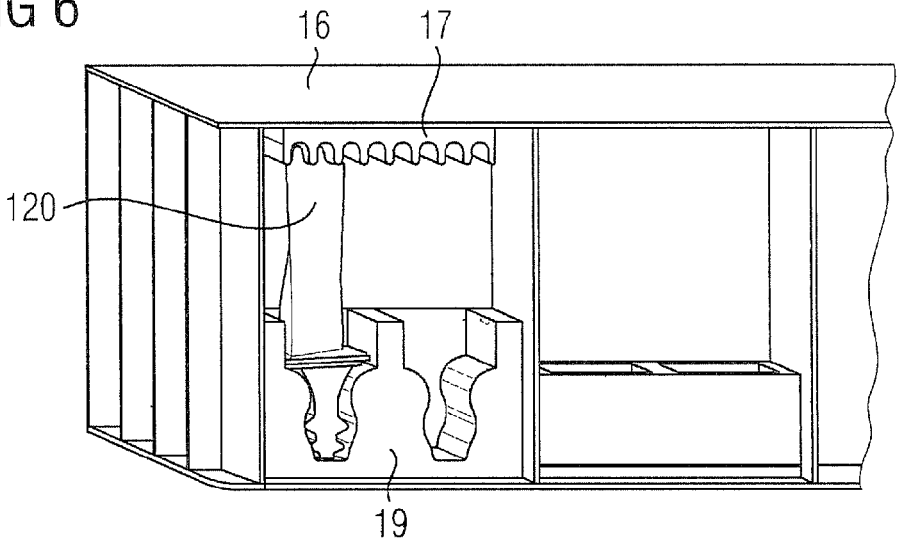

A receptacle 19, 22 can receive two blades or vanes 120, 130, but can also be equipped only with one blade or vane 120, 130 (FIG. 4), even if the receptacle 19, 22 could receive two blades or vanes 120, 130 (FIG. 6).

The receptacle 19, 22 (FIGS. 4, 6, 8) preferably consists of a plastics foam, preferably PE foam. This blade or vane receptacle 19, 22 can receive one or two blades or vanes 120, 130.

In the case of a rotor blade 120, the blade receptacle 19 has a depression 19', which can preferably be formed in accordance with the blade root 400, preferably like a fir tree, and can preferably be pushed from the side into the blade receptacle 19. The blade receptacle 19 thus has a lateral opening 19" and an upper opening 19'".

The blade receptacle 19 (FIGS. 4, 6, 8) preferably represents a negative of a region (blade root 400) of the turbine component 120, 130.

The turbine component 120 (or a plurality thereof) is preferably firstly inserted into the receptacle 19 and then introduced together therewith into the compartment 25', 25" of the plug-in divider 13'.

In the case of guide vanes 130 having two platforms, the guide vane 130 is placed from above into an opening 22' in the vane receptacle 22. The vane receptacle 22 thus preferably has only an upper opening 22'.

The blade or vane platforms 403 are preferably arranged within the receptacle 19, 22, i.e. the components 120, 130 do not protrude beyond the receptacles 19, 22. A plug-in divider cover 16 is preferably placed on the plug-in divider 13' and preferably additionally fixes the turbine blade or vane 120, 130. The plug-in divider cover 16 is preferably only a plate.

The fixing means 17 are preferably provided by a layer of a foam (see also FIGS. 6, 10) on the underside of the plug-in divider cover 16, which pushes into the end of the turbine blade or vane 120, 130.

Figure 5:
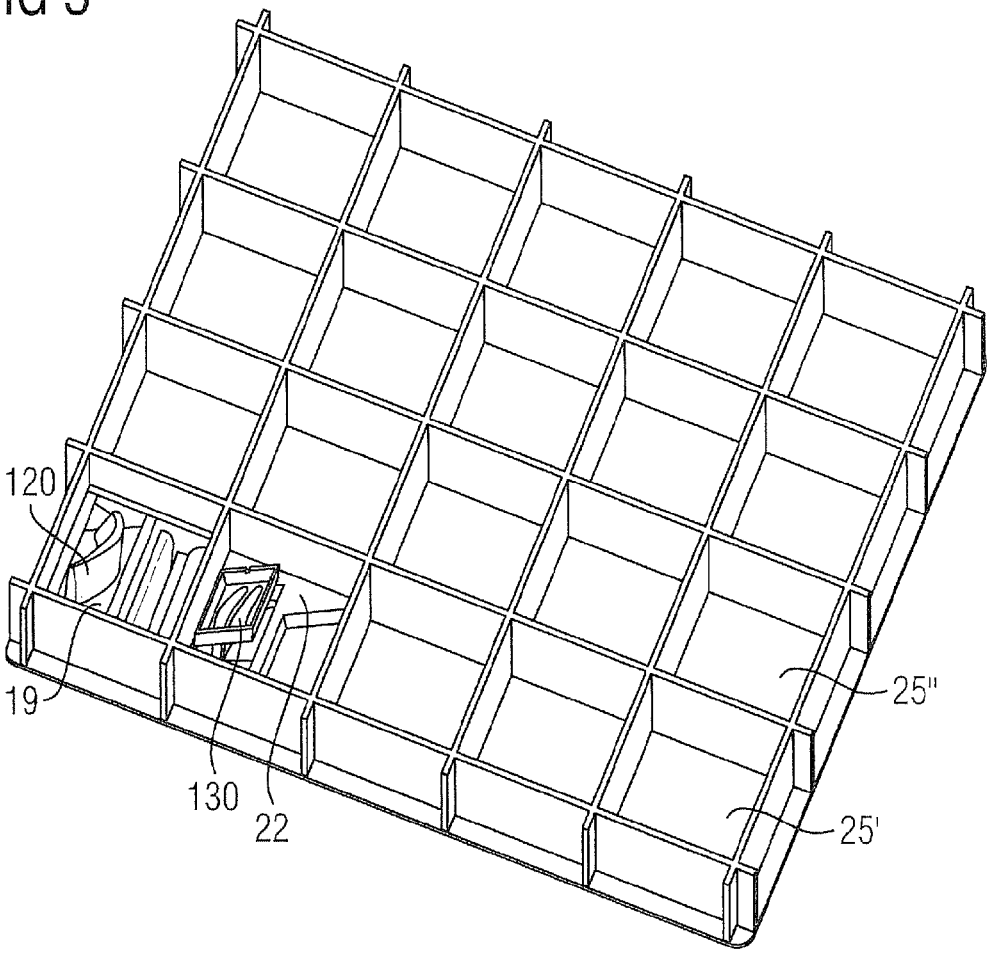

FIG. 5 shows a plan view of FIG. 2.

The inner packaging 10' therefore comprises at least: a plug-in divider 13', receptacles 19, 22 and various covers (FIGS. 3, 4, 8), here plug-in divider covers 16.

Figure 10:
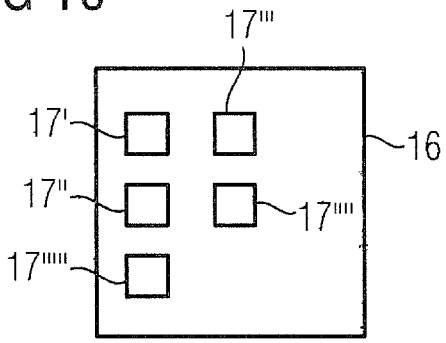

FIG. 10 shows a plan view of an underside of the plug-in divider cover 16.

The fixing means 17 are formed by a plurality of cuboids or cubes 17', 17", which fit exactly into a compartment 25', 25", 25". Therefore, the plug-in divider cover 16 is preferably supported directly on the plug-in divider 13', 13", 13'", and the fixing means 17', 17", . . . protrude into the compartments 25', 25", . . . .

Figure 3:
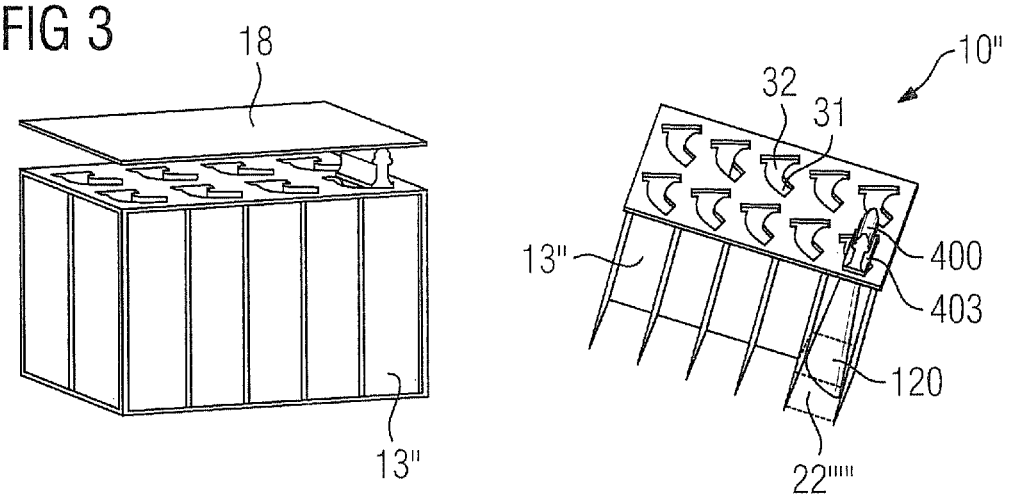

FIG. 3 shows a further inner packaging 10" according to the invention, this being used with preference for relatively long turbine blades or vanes having only one platform, in particular for rotor blades 120.

In the plane, the plug-in divider 13" likewise fills the internal space 7 of the outer packaging.

The rotor blade 120 is fixed so as to hang; it is preferably fixed by means of a suspending contoured plate 31. The suspending contoured plate 31 comprises an opening 32, through which the blade 120 is inserted first by way of the blade tip 415.

The suspending contoured plate 31 is preferably made in one piece and is preferably supported on the plug-in divider 13", or is fixedly connected to the plug-in divider 13".

The blade 120 is inserted through the suspending contoured plate 31 into the compartment 25' of the plug-in divider 13", the platform 403 being supported on the suspending contoured plate 31 or at least protruding beyond the latter 31.

The blade roots 400 protrude out of the contoured plate 31 and can be covered by a protective cover 18, onto which a further plug-in divider can be placed.

The protective cover 18 preferably does not comprise any fixing means.

Since the main blade or vane part 406 of the turbine blade or vane 120, 130 is twisted, the opening 32 in the suspending contoured plate 31 is accordingly wider than the cross section of the main blade or vane part 406, such that, upon insertion of the blade 120, it guides the main blade part 406 into a defined end position, and holds it there.

A receptacle 22''''', which fixes the end of the turbine blade 120, is preferably present at the end of the compartment 25'. The receptacle 22''''' is preferably foam-like.

Figure 4:
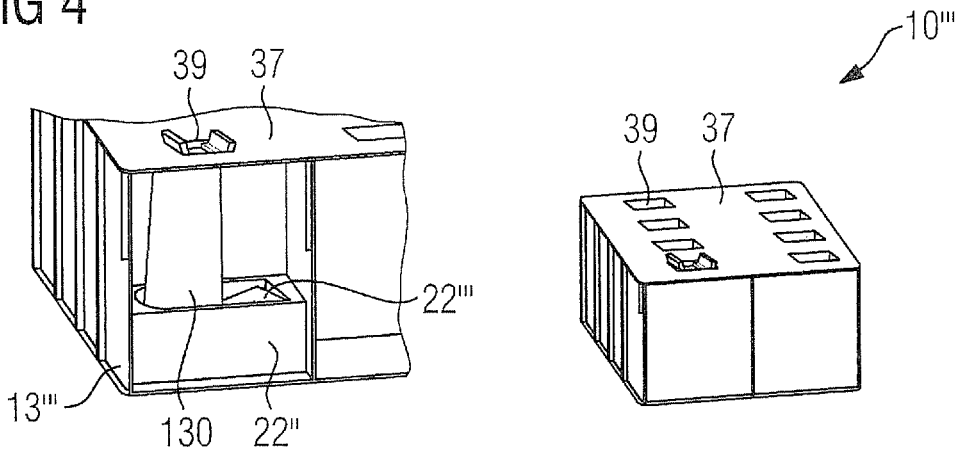

FIG. 4 shows a further inner packaging 10'" according to the invention, in particular for long guide vanes 130 having two platforms.

The guide vanes 130 are fixed standing within a plug-in divider 13'".

At the base of the compartment 25', there is likewise a receptacle 22", preferably made of a foam, into which the guide vane 130 is inserted from above. The receptacle 22" comprises only an upper opening 22'".

A contoured plate 37 is then placed onto the plug-in divider 13'".

The contoured plate 37 preferably comprises at least one opening 39, which encloses the upper platform of the turbine blade 120 and thereby stabilizes the other end of the turbine vane 130 at the top.

Here, a protective cover (as in FIG. 3) can likewise also be used.

FIG. 6 is a detailed illustration of FIG. 2, with the foam 17 which serves for fixing the component 120, 130. The fixing means 17 are a groove-like or wavy arrangement made of a foam. This is preferably a PE foam which has a corrugated structure.

The turbine components 120, 130 are arranged individually or as a pair in a compartment 25', 25" of the plug-in divider 13', 13", but always in such a way that the components do not touch one another.

Figure 7:
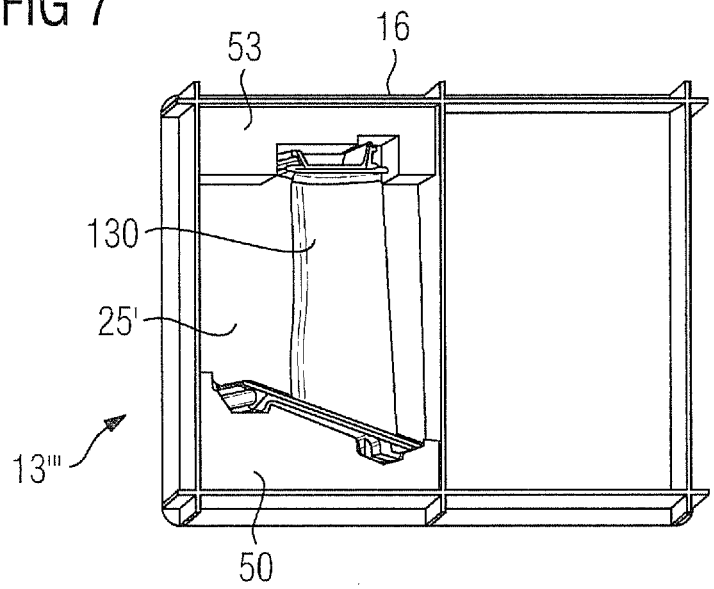

FIG. 7 is a detailed illustration of a rotor blade 130 in a compartment 25' of a plug-in divider 13'".

The main rotor blade part 406 stands vertically in the compartment 25', i.e. the receptacle 50 is adapted accordingly and has an obliquely running surface. Vertical means: the longitudinal axis of the turbine blade 130 stands vertically on the base in the plug-in divider 13'".

Figure 8:
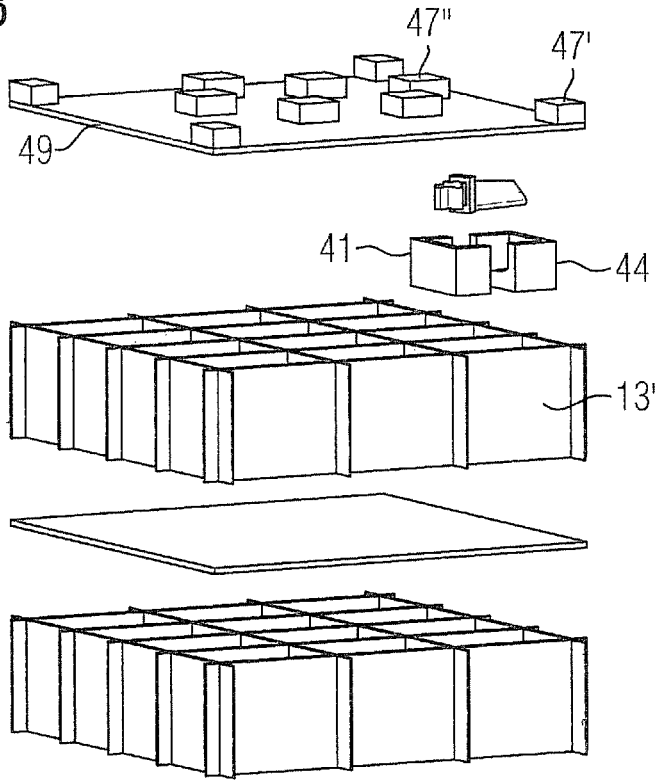
Figure 9:
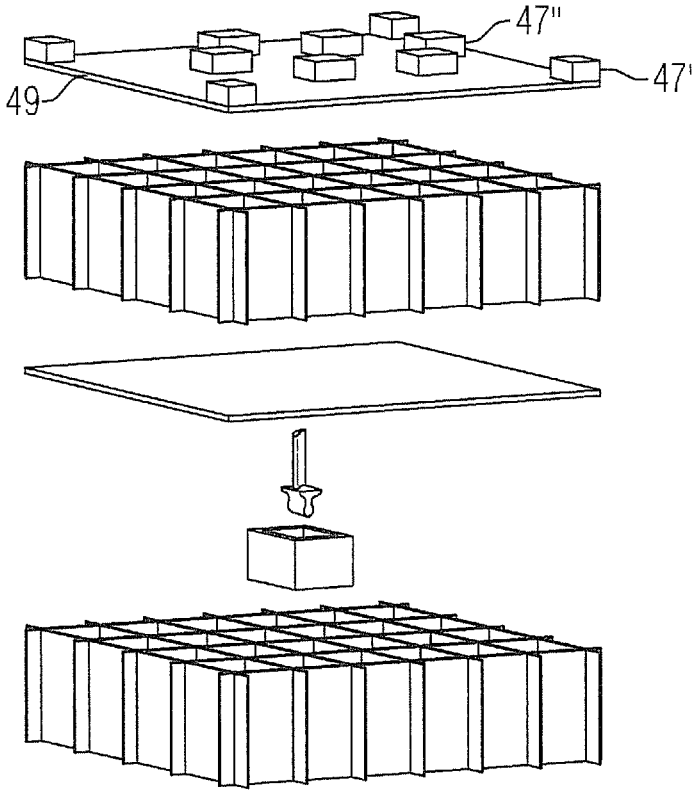

Lying means that the longitudinal axis runs parallel to the base of the plug-in divider (FIG. 8).

A lower receptacle 50 and an upper receptacle 53 are present in the compartment 25' and encompass the turbine part 120 at the ends thereof, here the platforms 403.

The receptacle 53 is effectively a specially preformed fixing means 17', 17", . . . as per FIG. 6.

Here, it is likewise possible for a plug-in divider cover 16 to be used.

The receptacles 50, 53 can be in the form of separate modules of the inner packaging 10', 10", . . . , or else can be arranged fixedly in the compartment 25' or fastened to the plug-in divider cover 16 (53 on 16).

In FIG. 8, there are two receptacles 41, 44, which are arranged laterally alongside one another in a compartment 25' of the plug-in divider 13'.

To this end, two lateral receptacles 41, 44 are present.

The lateral receptacles 41, 44 must not touch one another in the compartment 25', 25", . . . .

In a single plug-in divider 13', . . . , components 120, 130 can be arranged lying (FIG. 8) and standing (e.g. FIG. 7).

The shipment packaging 1 can comprise a plurality of layers of plug-in dividers 13', 13", 13'" with a plug-in divider cover 16, a protective cover 18 or contoured plates 31.

Similarly, by virtue of separated blocks 47', 47" on the side of an insert 49 which directly faces the outer cover, the pressure of the outer cover can preferably be passed onto the plug-in dividers 13', 13", . . . , so that the latter cannot move. The insert 49 is preferably used only once at the very top.

The outer cover is preferably tied to the outer packaging 4 by straps.

Technical documents and accompanying papers can be shipped at the same time between the blocks 47', 47", the blocks 47', 47" being arranged in such a way that they delimit an area for the documents and hold the documents in the plane.

The plug-in dividers 13', 13" are known in terms of structure and assembly from the prior art.

The extent of the plug-in dividers 13', 13", . . . in the plane is such that it fits flush into the internal space 7 of the outer packaging 4.

Figure 11:
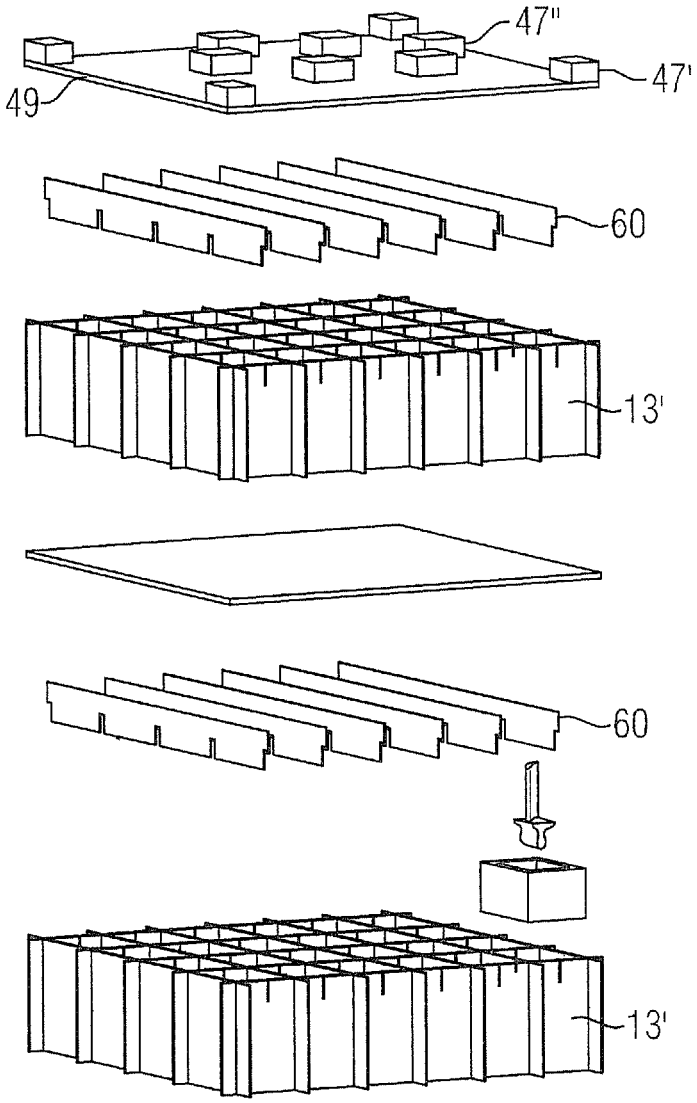

FIG. 11 shows a further configuration of the invention.

Here, use is made of reinforcements 60 for the plug-in dividers 13', 13", . . . of the plug-in dividers 13', 13", . . . already described above.

The reinforcements 60 preferably extend over the entire width or depth of the plug-in divider 13' and, like the elements of the plug-in divider 13', similarly have a plate-like form, but are not so high, so that they extend over the entire depth of the plug-in divider 13'.

The reinforcements 60 have appropriate indentations so that they can be pushed into corresponding indentations in the plug-in divider 13', such that the topmost edge of the reinforcement 60 preferably terminates with the topmost edge of the plug-in divider 13'.

Therefore, the side walls of the compartments 25', 25", . . . can buckle to a lesser extent and are more rigid.

Figure 12:
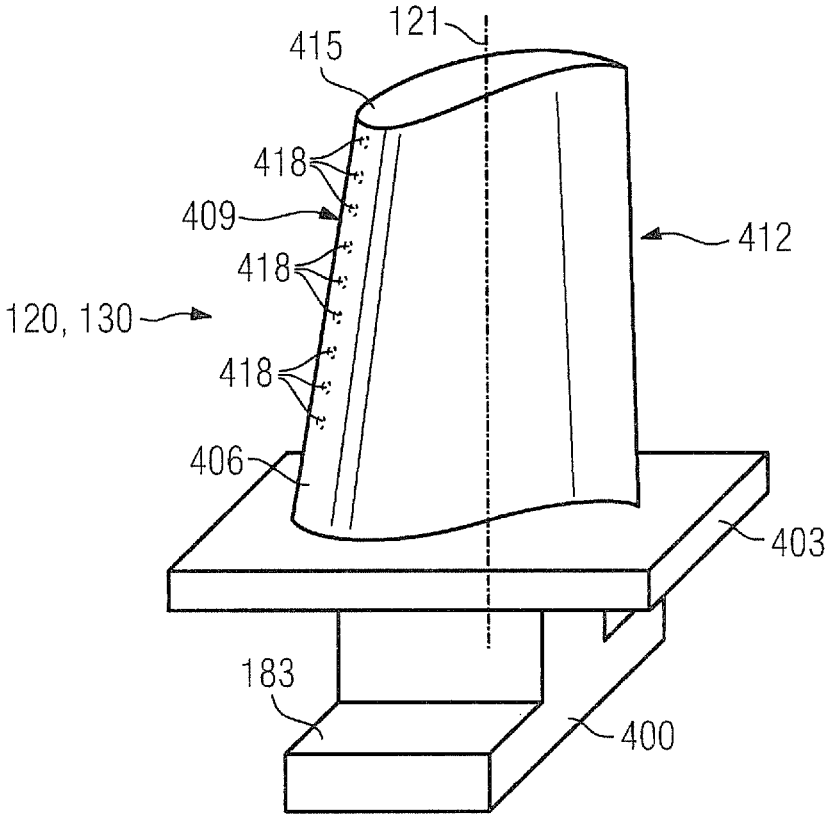
FIG. 12 shows a turbine blade or vane.

FIG. 12 shows a perspective view of a rotor blade 120 or guide vane 130 of a turbomachine, which extends along a longitudinal axis 121.

The turbomachine may be a gas turbine of an aircraft or of a power plant for generating electricity, a steam turbine or a compressor.

The blade or vane 120, 130 has, in succession along the longitudinal axis 121, a securing region 400, an adjoining blade or vane platform 403 and a main blade or vane part 406 and a blade or vane tip 415.

As a guide vane 130, the vane 130 may have a further platform (not shown) at its vane tip 415.

A blade or vane root 183, which is used to secure the rotor blades 120, 130 to a shaft or a disk (not shown), is formed in the securing region 400.

The blade or vane root 183 is designed, for example, in hammerhead form. Other configurations, such as a fir tree or dovetail root, are possible.

The blade or vane 120, 130 has a leading edge 409 and a trailing edge 412 for a medium which flows past the main blade or vane part 406.

In the case of conventional blades or vanes 120, 130, by way of example solid metallic materials, in particular superalloys, are used in all regions 400, 403, 406 of the blade or vane 120, 130.

Superalloys of this type are known, for example, from EP 1 204 776 B1, EP 1 306 454, EP 1 319 729 A1, WO 99/67435 or WO 00/44949.

The blade or vane 120, 130 may in this case be produced by a casting process, by means of directional solidification, by a forging process, by a milling process or combinations thereof.

Workpieces with a single-crystal structure or structures are used as components for machines which, in operation, are exposed to high mechanical, thermal and/or chemical stresses.

Single-crystal workpieces of this type are produced, for example, by directional solidification from the melt. This involves casting processes in which the liquid metallic alloy solidifies to form the single-crystal structure, i.e. the single-crystal workpiece, or solidifies directionally.

In this case, dendritic crystals are oriented along the direction of heat flow and form either a columnar crystalline grain structure (i.e. grains which run over the entire length of the workpiece and are referred to here, in accordance with the language customarily used, as directionally solidified) or a single-crystal structure, i.e. the entire workpiece consists of one single crystal. In these processes, a transition to globular (polycrystalline) solidification needs to be avoided, since non-directional growth inevitably forms transverse and longitudinal grain boundaries, which negate the favorable properties of the directionally solidified or single-crystal component.

Where the text refers in general terms to directionally solidified microstructures, this is to be understood as meaning both single crystals, which do not have any grain boundaries or at most have small-angle grain boundaries, and columnar crystal structures, which do have grain boundaries running in the longitudinal direction but do not have any transverse grain boundaries. This second form of crystalline structures is also described as directionally solidified microstructures (directionally solidified structures).

Processes of this type are known from U.S. Pat. No. 6,024,792 and EP 0 892 090 A1.

The blades or vanes 120, 130 may likewise have coatings protecting against corrosion or oxidation e.g. (MCrAlX; M is at least one element selected from the group consisting of iron (Fe), cobalt (Co), nickel (Ni), X is an active element and stands for yttrium (Y) and/or silicon and/or at least one rare earth element, or hafnium (HO). Alloys of this type are known from EP 0 486 489 B1, EP 0 786 017 B1, EP 0 412 397 B1 or EP 1 306 454 A1.

The density is preferably 95% of the theoretical density.

A protective aluminum oxide layer (TGO=thermally grown oxide layer) is formed on the MCrAlX layer (as an intermediate layer or as the outermost layer).

The layer preferably has a composition Co-30Ni-28Cr-8Al-0.6Y-0.7Si or Co-28Ni-24Cr-10Al-0.6Y. In addition to these cobalt-based protective coatings, it is also preferable to use nickel-based protective layers, such as Ni-10Cr-12Al-0.6Y-3Re or Ni-12Co-21Cr-11Al-0.4Y-2Re or Ni-25Co-17Cr-10Al-0.4Y-1.5Re.

It is also possible for a thermal barrier coating, which is preferably the outermost layer, to be present on the MCrAlX, consisting for example of $ZrO_2$, $Y_2O_3$—$ZrO_2$, i.e. unstabilized, partially stabilized or fully stabilized by yttrium oxide and/or calcium oxide and/or magnesium oxide.

The thermal barrier coating covers the entire MCrAlX layer.

Columnar grains are produced in the thermal barrier coating by suitable coating processes, such as for example electron beam physical vapor deposition (EB-PVD).

Other coating processes are possible, e.g. atmospheric plasma spraying (APS), LPPS, VPS or CVD. The thermal barrier coating may include grains that are porous or have micro-cracks or macro-cracks, in order to improve the resistance to thermal shocks. The thermal barrier coating is therefore preferably more porous than the MCrAlX layer.

Refurbishment means that after they have been used, protective layers may have to be removed from components 120, 130 (e.g. by sand-blasting). Then, the corrosion and/or oxidation layers and products are removed. If appropriate, cracks in the component 120, 130 are also repaired. This is followed by recoating of the component 120, 130, after which the component 120, 130 can be reused.

The blade or vane 120, 130 may be hollow or solid in form. If the blade or vane 120, 130 is to be cooled, it is hollow and may also have film-cooling holes 418 (indicated by dashed lines).

The invention claimed is:

1. An arrangement to carry elongate components, comprising: a shipment packaging for elongate components, comprising:

a stable outer packaging consisting of an open container with an outer cover, and an internal space of the outer packaging in which there is an inner packaging, wherein the inner packaging comprises a plug-in divider and a receptacle, and wherein the plug-in divider comprises a plurality of compartments; and an elongate component, wherein the receptacle holds the elongate component in a compartment of the plug-in divider and such that the elongate component is held standing in the receptacle with a length of the elongate component standing upwardly, wherein the receptacle includes a depression with a contour corresponding to a contour of a portion of the elongate component, and wherein the arrangement is configured such that the elongate component does not come into contact with a further elongate component, and wherein the elongate component is a turbine component, wherein a plug-in divider cover is present at least in one layer, and wherein the plug-in divider cover comprises means for fixing the elongate component.

2. The arrangement as claimed in claim 1, wherein the plug-in divider comprises polypropylene trilaminate.

3. The arrangement as claimed in claim 1, wherein a plurality of inner packagings are present one above another in layers in the internal space of the outer packaging.

4. The arrangement as claimed in claim 1, wherein two components are arranged in a compartment of the plug-in divider.

5. The arrangement as claimed in claim 1, wherein only one component is arranged in a compartment of the plug-in divider.

6. The arrangement as claimed in claim 1, wherein the receptacle receives only one elongate component.

7. The arrangement as claimed in claim 1, wherein the receptacle receives two elongate components.

8. The arrangement as claimed in claim 7, wherein the receptacle receives only identical components.

* * * * *